United States Patent [19]

Mitchell

[11] Patent Number: 4,901,889

[45] Date of Patent: Feb. 20, 1990

[54] APPARATUS FOR MOUNTING A TISSUE ROLL AND DISPENSING A FLOWABLE SUBSTANCE

[76] Inventor: Joseph Mitchell, 303 S. Hampshire Dr., Deptford, N.J. 08096

[21] Appl. No.: 298,121

[22] Filed: Jan. 18, 1989

[51] Int. Cl.[4] ..... B67D 5/06

[52] U.S. Cl. ..... 222/153; 222/192; 239/52; 242/55.2

[58] Field of Search ..... 222/153, 180, 182–183, 222/192, 394, 402.1, 402.11, 402.13, 402.15, 499, 526, 190; 239/52, 274, 289, 324, 331; 242/55.2, 55.55; 118/325; 4/222

[56] References Cited

U.S. PATENT DOCUMENTS

| | | | |
|---|---|---|---|
| 2,639,939 | 5/1953 | Matchett | 242/55.55 |
| 2,746,798 | 5/1956 | Wardell, Jr. | 239/274 |
| 3,151,822 | 10/1964 | Glaner | 242/55.55 |
| 3,336,603 | 8/1967 | Leland | 222/402.13 X |
| 3,608,785 | 9/1971 | Durso et al. | 222/182 |
| 3,848,822 | 11/1974 | Boone | 242/55.2 |
| 4,226,340 | 10/1980 | Troesch | 222/183 |
| 4,436,224 | 3/1984 | McInerny | 222/183 |
| 4,759,510 | 7/1988 | Singer | 242/55.2 |

*Primary Examiner*—Michael S. Huppert
*Attorney, Agent, or Firm*—Burns, Doane, Swecker & Mathis

[57] ABSTRACT

An apparatus for mounting a tissue roll and for dispensing a flowable substance, such as cleansing foam, comprises a canister body containing the substance. The canister body is adapted to be coaxially disposed within a core of a tissue roll and includes a nozzle at one end. Support sleeves are mounted on opposite ends of the canister body and carry axial hubs adapted to be received to recesses of a wall fixture. One of the sleeve carries a laterally extending dispensing handle which contains a lateral passage. An upper end of the passage communicates with the canister nozzle, and a lower end of the passage defines an outlet in the form of a series of discharge channels. By depressing the handle relative to the sleeve, the nozzle is depressed to emit the substance which travels through the passage and exits the discharge channels onto tissue held by the user. Upper ends of the channels communicate with an expansion chamber formed in the passage to cause the substance to slow in speed just prior to exiting the handle, in order to produce a gentler dispensing of the substance.

20 Claims, 4 Drawing Sheets

Fig. 15
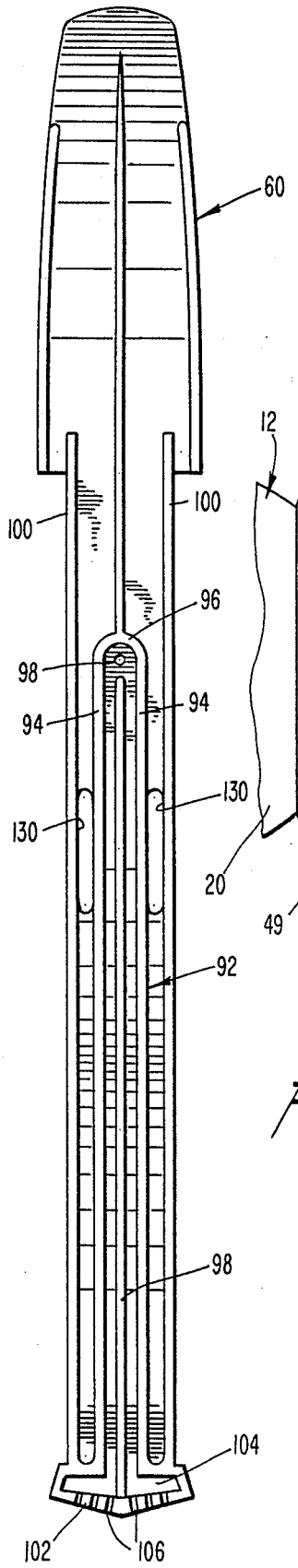
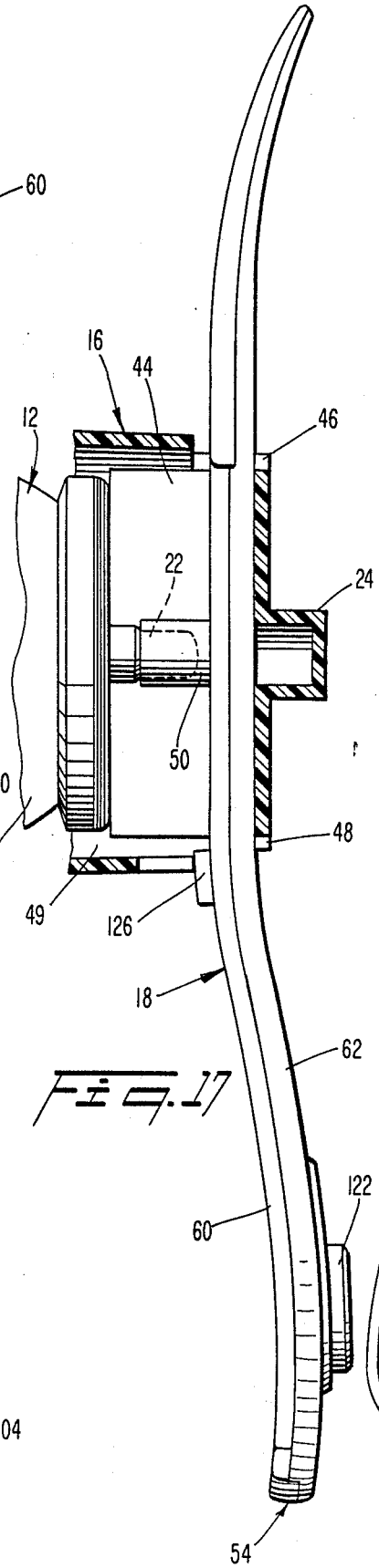
Fig. 17
Fig. 16
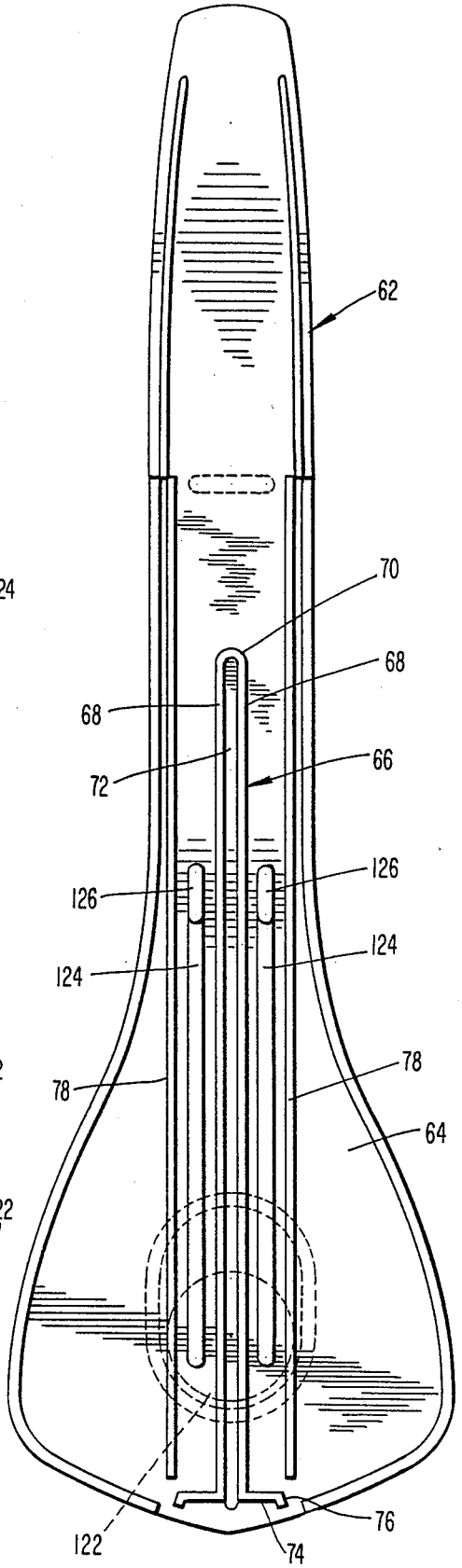

APPARATUS FOR MOUNTING A TISSUE ROLL AND DISPENSING A FLOWABLE SUBSTANCE

BACKGROUND OF THE INVENTION

The present invention relates to a mounting apparatus for mounting a roll of tissue in a wall fixture or the like and which incorporates means for dispensing a flowable substance.

Such a mounting apparatus has previously been proposed, for example, in Glaner U.S. Pat. No. 3,151,822. That patent discloses an aerosol canister having a pair of support members mounted thereon at opposite ends. A first of the support members is mounted on the canister body, and the second is mounted directly on the canister nozzle. Each support member carries a hub which is insertable into a corresponding recess of a wall fixture. When the apparatus is inserted into the center core of a conventional toilet tissue roll, the hubs project beyond the axial ends of the roll and are thus insertable into the fixture recesses. To facilitate such insertion, the first support member is resiliently biased axially outwardly by a coil spring. Once inserted, the nozzle can be actuated to spray deodorant by axially depressing the second support member, whereupon the deodorant travels through a lateral passage formed int he second support member.

It will be appreciated that care must be taken during installation of the apparatus into the holder to prevent the second support member from being depressed, because such depression will produce inadvertent spraying of deodorant.

Also, since part of the combined weight of the canister and tissue roll is borne by the canister nozzle, the apparatus might not be usable with the type of canister which is actuated by a radial (as opposed to axial) depression of the nozzle, since the vertical forces acting on the nozzle for supporting the load might produce inadvertent dispensing of fluid.

Moreover, since the axial depression of the second support member during a spraying procedure produces a simultaneous displacement of the associated hub in a direction out of the fixture recess, there exists the possibility that the apparatus could become inadvertently dislodged from the fixture.

Another type of tissue support/fluid dispenser is disclosed in Wardell, Jr. U.S. Pat. No. 2,746,898. In that apparatus the deodorant spray is emitted in the longitudinal direction of the canister. Thus, the canister must be suspended away from the wall in order to be actuable. That is, such apparatus cannot be installed in the customary manner within a wall fixture.

Among other features, the present invention envisions a dispenser capable of dispensing a foam, such as a cleansing foam. It will be appreciated that deodorant dispensers of the type described above would present shortcomings in the dispensing of foam wherein a foamable liquid is discharged from the canister. That is, the liquid would exit the discharge handle at high speed against the receiving object, such as toilet tissue held by the user, and may rebound from that object in a manner making a mess.

It is, therefore, an object of the invention to provide a combined dispenser and tissue roll support which avoids the afore-mentioned shortcomings.

SUMMARY OF THE PREFERRED EMBODIMENT OF THE INVENTION

The present invention involves an apparatus for rotatably mounting a roll of tissue in a holder and for dispensing a flowable substance. The apparatus comprises a canister including a body which contains a flowable substance under pressure, and a discharge nozzle at one end of the body. The canister is adapted to be coaxially disposed within a core of a tissue roll. A support structure is mounted on the canister body and includes first and second support members disposed at opposite ends of the canister body. Those support members carry first and second mounting structures, respectively, such as axially projecting hubs which are coaxially and rotatably mountable in a holder. A dispensing handle is mounted on a second support member and extends laterally outwardly therefrom. The handle includes an aperture receiving the canister nozzle, and a passage extending laterally of the aperture. One end of the passage communicates with the aperture and another end of the passage defines an outlet opening adjacent an outer end of the handle. The dispensing handle is movable relative to the second support member to cause the canister nozzle to be depressed and emit a flowable substance which travels through the passage and exits through the discharge outlet.

In a separate aspect of the invention, the passage in the handle includes an expansion chamber disposed immediately upstream of the discharge outlet to reduce the speed of a foamable substance emitted from the canister, and thereby produce a gentler discharge of that substance.

BRIEF DESCRIPTION OF THE DRAWINGS

The objects and advantages of the invention will become apparent from the following detailed description of preferred embodiments thereof in connection with the accompanying drawings in which like numerals designate like elements, and in which:

FIG. 15 is a side elevational view of a front half of the dispensing handle;

FIG. 16 is a side elevational view of a rear half of the dispensing handle; and

FIG. 17 is a longitudinal sectional view similar to FIG. 4, with the dispensing handle in a locked, nondispensing mode.

DETAILED DESCRIPTION OF PREFERRED EMBODIMENTS OF THE INVENTION

Figure 1:
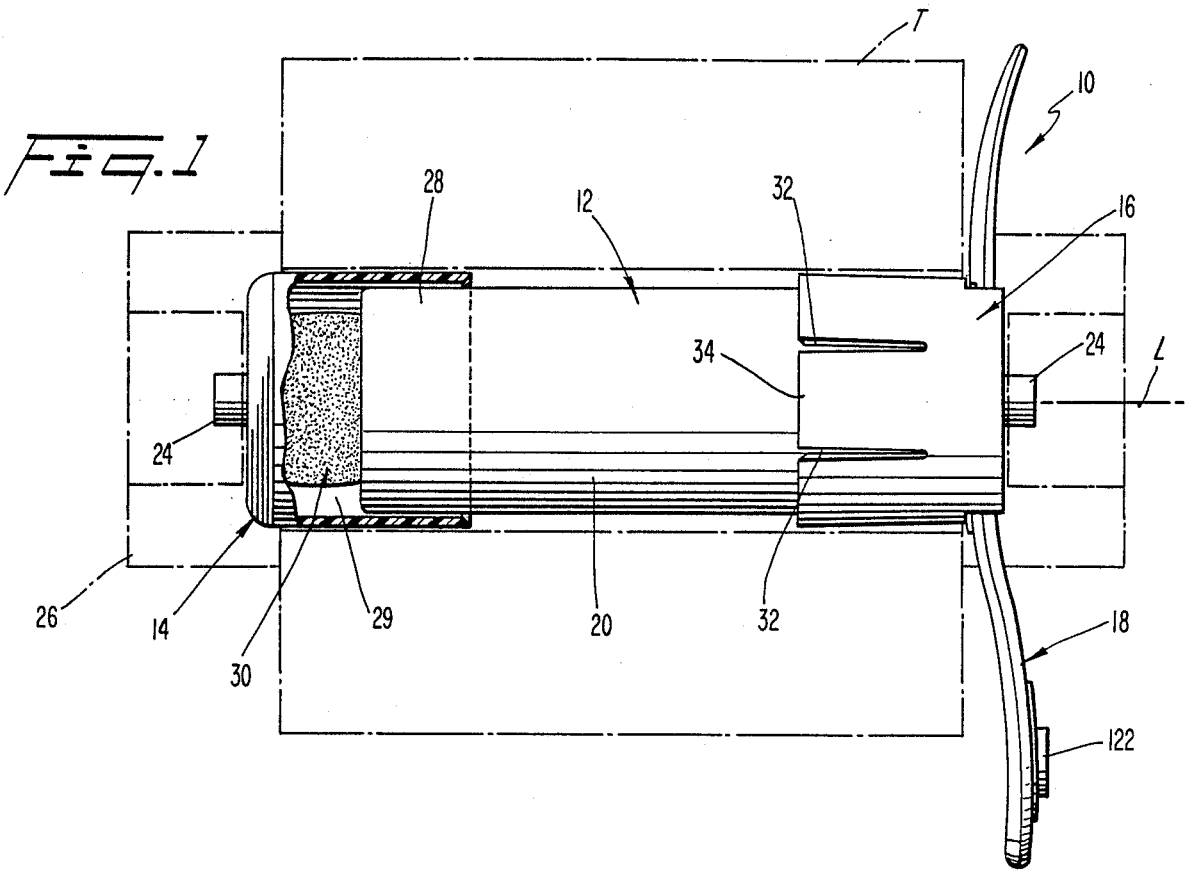
FIG. 1 is a side elevational view of an apparatus according to the present invention, with one end thereof broken away, and with a tissue roll shown in phantom.
Figure 2:
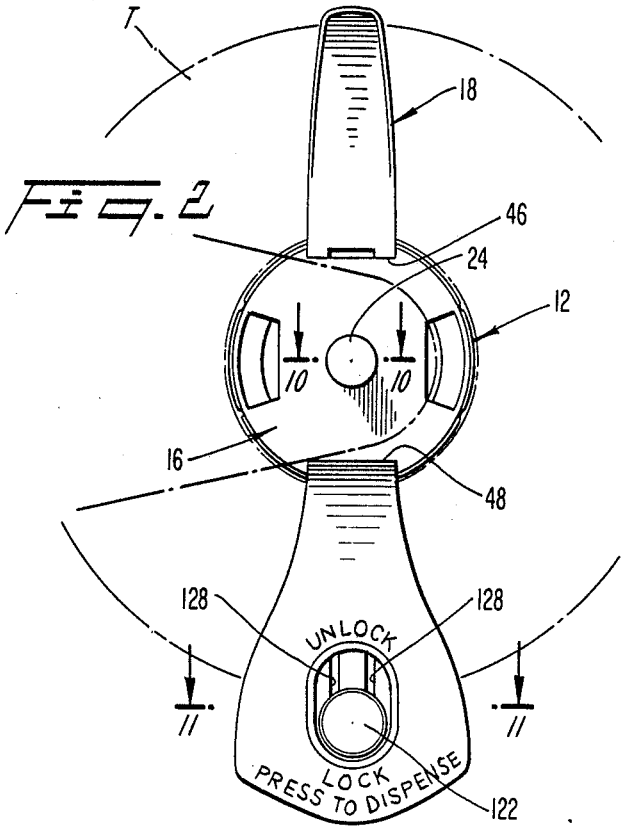
FIG. 2 is an end view of an apparatus depicted in FIG. 1.

In accordance with the present invention, a mounting apparatus 10 for a roll of toilet tissue T comprises a canister 12, a pair of sleeves 14, 16 mounted at opposite ends of the canister 12, and a manually actuable dispensing handle 18 disposed in one of the sleeves 16 and movable relative thereto to dispense a fluid from the canister.

Figure 4:
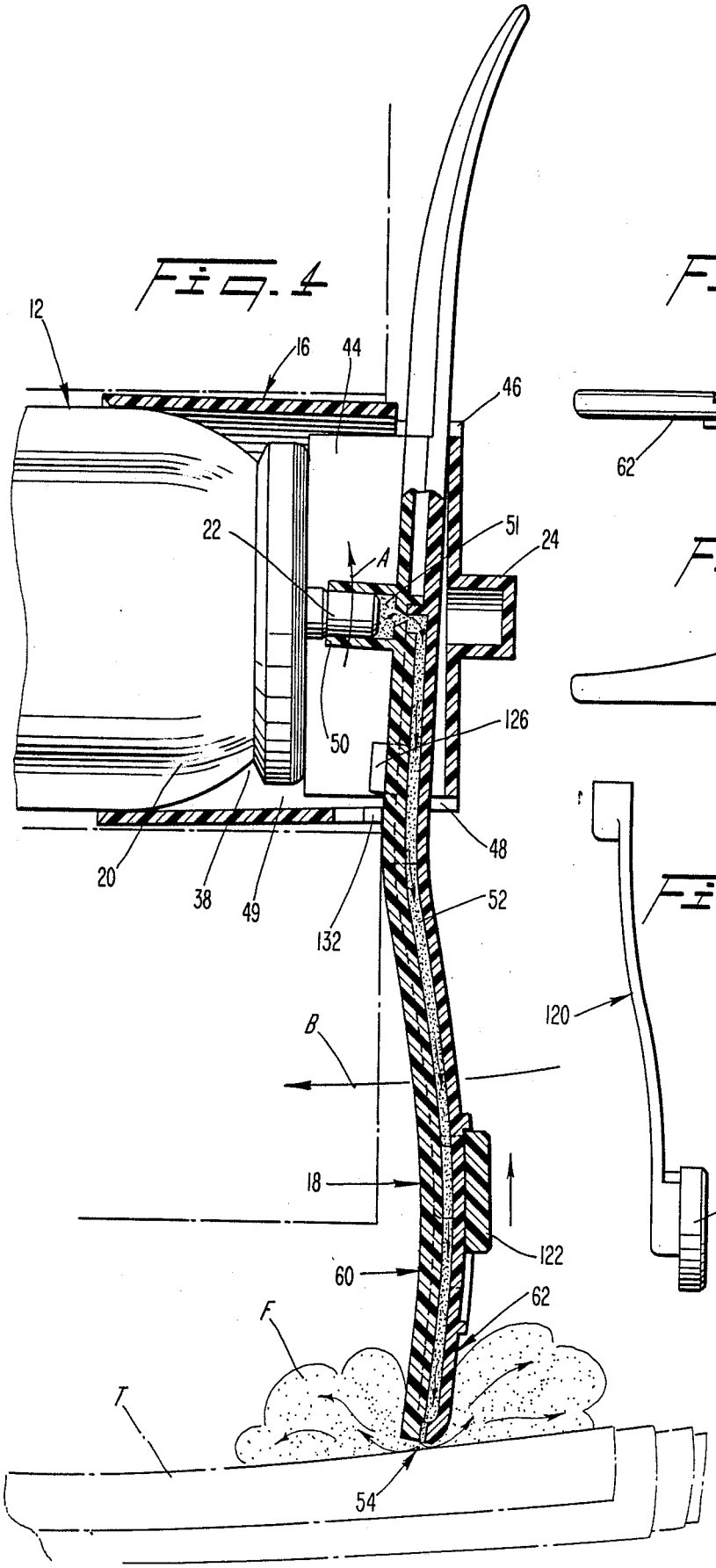
FIG. 4 is a longitudinal sectional view through a fluid dispensing end of the apparatus, depicting the apparatus in a fluid dispensing mode of operation.

The canister can be of a conventional type which includes a cylindrical body 20 and a dispensing nozzle 22. The body contains a fluid under pressure, e.g., an aerosol canister. The fluid may be of any suitable type including a foamable cleansing liquid which includes a soap or emulsion. The nozzle 22 extends axially and emits liquid in response to a radial depression of the outer end of the nozzle as indicated by the arrow A in FIG. 4.

The sleeves 14, 16 are of generally hollow cylindrical construction and have axially alignable recesses for receiving respective ends of the canister body 20. The sleeves carry axially outwardly extending cylindrical hubs 24 which are coaxial and adapted to be received in the recesses of a standard wall-mounted holder or fixture 26.

A first of the sleeves 14 includes a recess 29 which telescopingly receives an end 28 of the container which is remote from the nozzle 22. That recess 29 contains a spring 30, such as a block of elastic material, i.e., a material which returns to its initial form after being compressed. The spring 30 acts between the sleeve 14 and the canister body 20 to bias the sleeve axially outwardly in order to facilitate the insertion and removal of the apparatus relative to the holder.

Figure 12:
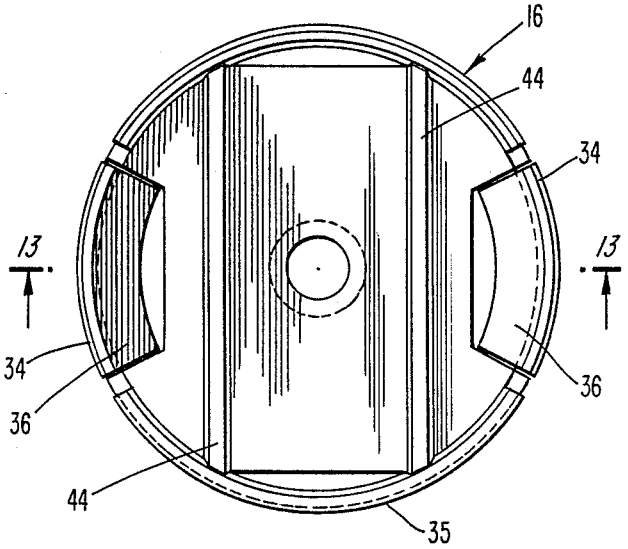
FIG. 12 is an end view of a support sleeve according to the present invention.
Figure 13:
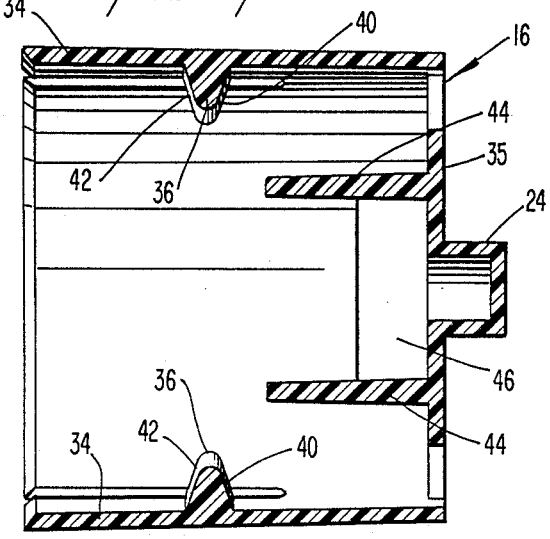
FIG. 13 is a longitudinal sectional view taken through the support sleeve depicted in FIG. 12.
Figure 14:
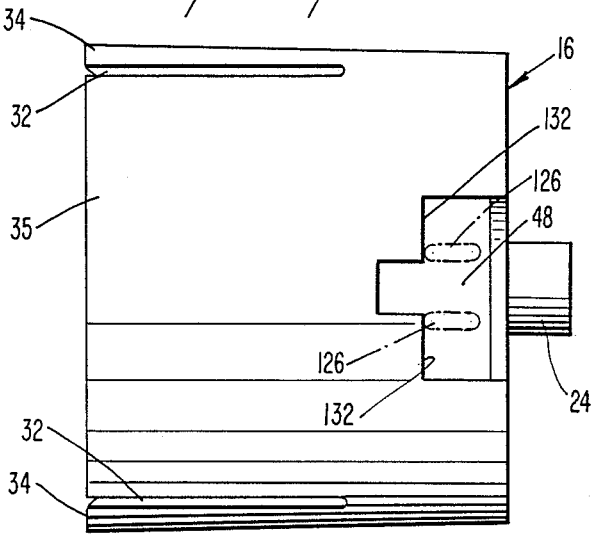
FIG. 14 is a side elevational view of the support sleeve depicted in FIG. 13.

The second sleeve 16 is formed with two pairs of circumferentially spaced, axially extending slits 32 which define a pair of flexible latching elements 34 (see FIGS. 12–14) which can be flexed relative to the remaining or main portion 35 of the sleeve 16. Each of those elements 34 carries a radially inwardly projecting curved lug 36 adapted to be received within an annular groove 38 in the outer periphery of the canister body for retaining the sleeve 16 axially immovably on the canister body. By prying the elements 34 radially outwardly, the sleeve 16 can be removed from the canister. Opposite sides 40, 42 of each lug are inclined to define cammable surfaces which facilitate insertion of the lugs into and from the groove 38.

The main portion 35 of the second sleeve 16 includes a pair of walls 44 (FIGS. 12, 13) which rigidify that main portion 35. Formed in the main portion 35 of the sleeve 16 is a pair of diametrically opposed slots 46, 48 (FIGS. 2, 13, 14, 17) which are disposed in vertically superposed relationship when the apparatus is in an installed condition. A lower one of the slots 48 (FIG. 14) is T-shaped, whereas the upper slot 46 (FIG. 13) is rectangular. The slots are sized to receive the dispensing handle 18.

The handle 18 extends laterally relative to the common axis L defined by the hubs 24. When the apparatus is installed, the axis L extends horizontally and the handle 18 extends vertically.

An upper portion of the handle projects beyond the upper slot 46 and a lower portion of the handle projects beyond the lower slot 48. A front side of the handle carries a hollow projection 50 disposed within a recess 49 defined by the sleeve 16. That projection 50 forms an aperture 51 which receives the nozzle 22 with a relatively snug fit. Extending along the length of the handle 18 is a passage 52 (see FIG. 4) which communicates with the aperture 51 at its upper end and terminates in a discharge outlet 54 at its lower end. The lower slot 48 is sized to permit the handle to be moved relative to the sleeve 16 toward and away from the canister 12. That is, by manually applying a force to the lower portion of the handle, causing the handle to be rotated in direction B (see FIG. 4) about a fulcrum 56 defined by a region of contact between a back side of the handle and the sleeve 16, the nozzle 22 will be depressed radially in direction A to emit pressurized liquid. That liquid will travel through the aperture 51 and the passage 52 and be discharged through the outlet 54.

Figure 6:
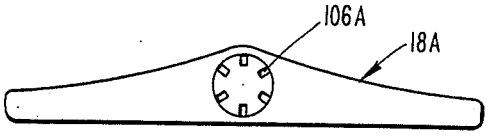
FIG. 6 is an end view of a modified form of the dispensing handle.

Depicted in FIGS. 15, 16, 10 and 11 is a rib arrangement which can be integrally molded with the handle and which defines the passage 52. The handle 18 comprises front and rear halves 60, 62 which are secured together. The rear half 62 (FIG. 6) comprises a plate portion 64 having a first upstanding rib 66 which includes a pair of parallel portions 68 interconnected at their upper ends by a bight portion 70.

The upper portion of the handle projects beyond the sleeve 16 by a distance sufficient to prevent the apparatus 10 from being rotated in a direction causing the lower end of the handle to be raised. That is, if during the removal of tissue from the roll forces are applied to the apparatus in a direction tending to rotate the apparatus counterclockwise as viewed in FIG. 2, the top portion of the handle 18 would engage the back wall of the holder 26 to prevent any appreciable rotation of the apparatus. Thus, it is assured that the handle dispensing outlet (to be described hereinafter) will always point downwardly).

A groove 72 is defined between the parallel portions 68. Extending at a right angle from the lower end of each parallel portion 68 is a foot 74 which terminates in a slightly downwardly inclined toe 76. Second and third parallel ribs 78 are spaced outwardly from the first rib 66 and extend to a greater height from the plate portion 64 than the first rib 66 (see FIG. 10).

Figure 10:
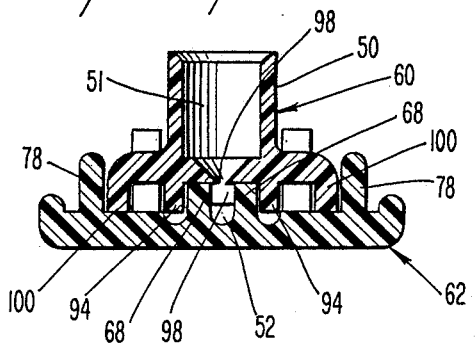
FIG. 10 is a cross-sectional view taken along the line 10—10 in FIG. 2.
Figure 11:
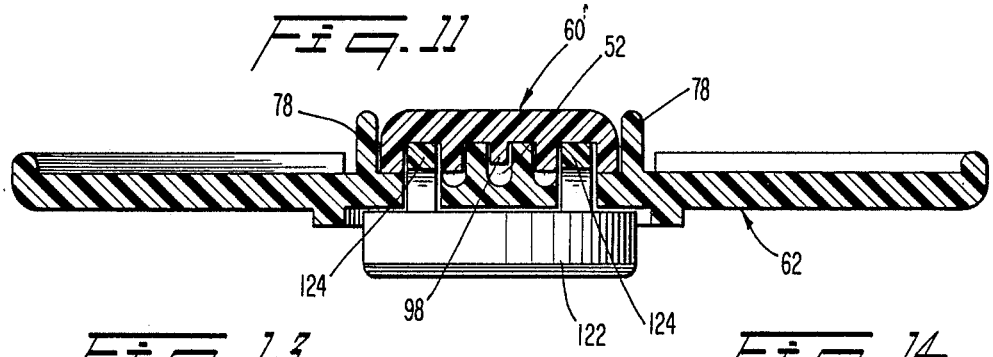
FIG. 11 is a cross-sectional view taken along the line 11—11 in FIG. 2.

The handle front half 60 comprises a plate portion 90 from which a fourth rib 92 projects. The rib 92 includes a pair of parallel portions 94 interconnected by a bight portion 96. A port 98 extends through the plate portion 90 in communication with the aperture 51 (see FIG. 10). Extending parallel to the rib portions 95 midway therebetween is a fifth rib 98 which is of shorter height than the rib portions 94 as can be seen in FIGS. 10, 11. The fifth rib 98 terminates in spaced relationship from the port 98. Also provided are sixth and seventh parallel ribs 100 disposed along the edges of the plate portion 90.

Figure 5:
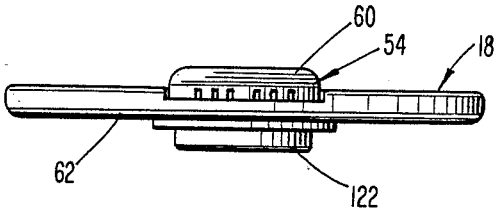
FIG. 5 is an end view of a dispensing handle according to the present invention.

Extending across the front end of the plate portion 90 is an eighth rib 102 which is joined to lower ends of the ribs 92, 100 in a manner forming a space 104 therebetween. Projecting through the eighth rib 102 is a plurality of downwardly extending discharge channels 106 which communicate with the space 104 and which define the discharge outlet. The channels 106 are of rectangular cross-section and are arranged in a row (see FIG. 5). Alternatively, the channels 106A could be arranged in other patterns, such as a circular pattern in an appropriately shaped handle 18A (see FIG. 6). The width of the rib 102 widens toward the center, whereby the lengths of the channels 106 become longer toward the center.

Figure 3:
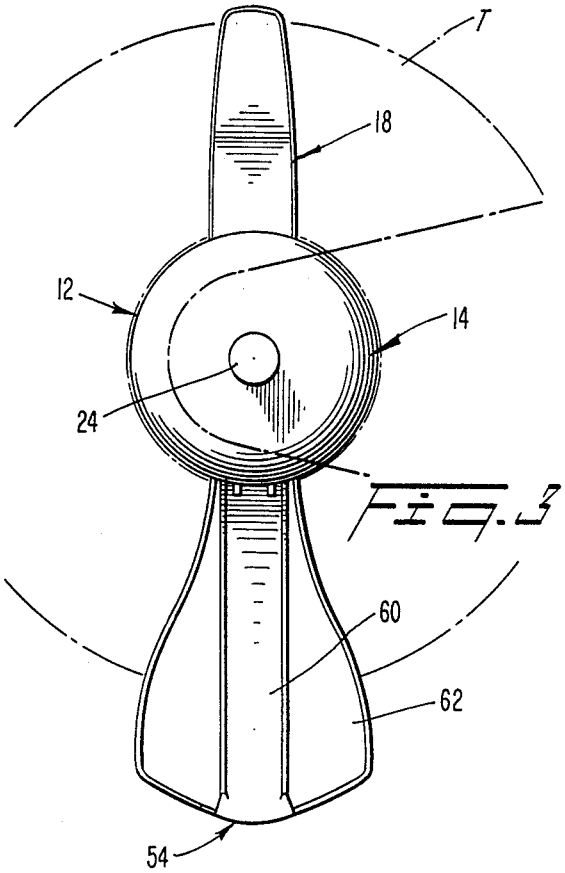
FIG. 3 is an opposite end view of the apparatus of FIG. 1.

The front half 60 is configured to mate with the rear half 62 in the manner depicted in FIGS. 3, 10 and 11 wherein the seventh and eighth ribs 100 lie to the inside of the ribs 78; the rib portions 94 lie just to the outside of the rib portions 68; and the fifth rib lies in the groove 52. The bight portion 70 lies just to the inside of the bight portion 96 (an outer radius of the former corresponds to the inner radius of the latter). The port 98 is spaced from the bight portion 96 by a distance greater than the width of the bight portion 70 so as to remain unblocked. Consequently, the groove 72 and the outer surface of the rib 98 form the passage 52 which communicates with the port 98 to conduct liquid from the nozzle 51 to the discharge channels 106. The port 98 is preferably of diminishing cross-section in a direction away from the nozzle. The outlet of the port is of smaller cross-section than the passage 52 so a slight reduction of speed of the liquid occurs as the liquid enters the passage 52. Actually, the liquid begins to foam to some extent as soon as it leaves the cannister. However, it remains in a condensed state, i.e., part foam, part liquid, as it travels along the passage 52 since it is confined in that passage.

Figure 9:
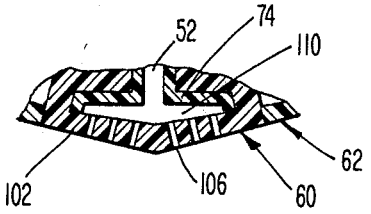
FIG. 9 is a sectional view taken through the lower end of the dispensing handle depicted in FIG. 5.

The feet 74 of the rear half 62 fit into the space 104 of the front half 60 in a manner forming an expansion chamber 110 immediately upstream of the discharge channels 106, as depicted in FIG. 9. The total cross-section of that chamber 110 is greater than the cross-section of the passage 52, whereby the foamable substance slows as it enters the expansion chamber 110 and virtually completes the conversion to foam, the foam then being pushed through the discharge channels 106. As a consequence of the above-described expanding and slowing action, the foam exits in a relatively gentle manner, avoiding a high-speed rebound off tissue being held beneath the discharge channels.

Figure 7:
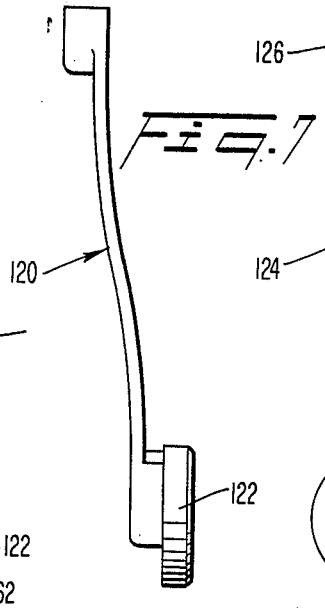
FIG. 7 is a side elevational view of a locking member according to the present invention.
Figure 8:
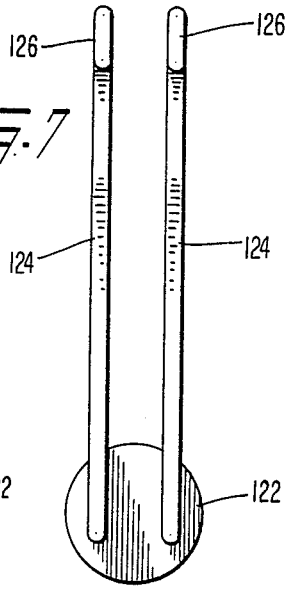
FIG. 8 is a front view of the locking member depicted in FIG. 7.

It is desirable that the handle be capable of being locked against actuation to inhibit unauthorized use by small children. This is accomplished by the provision of a lock 120 depicted in FIGS. 7 and 8. The lock comprises a circular actuator tab 122 from which extend a pair of parallel legs 124. Each leg terminates in a lug 126. The actuator tab 12 is disposed on the rear side of the handle, with the legs 124 extending into the interior of the handle through a pair of slots 128 formed in the rear half 62 of the handle (see FIG. 2). The lugs 126 project forwardly through two slots 130 formed in the front handle half 60. When the tab 122 and thus the lugs 126, are in the lowermost position, the lugs will be disposed opposite a pair of shoulders 132 forming the slot 48, as depicted in phantom lines in FIG. 14 and in solid lines in FIG. 17. Hence, the handle cannot be displaced toward the canister 12 to actuate the nozzle. By sliding the tab 122 upwardly, the lugs 126 will be located above the shoulders 132 (see FIG. 4), whereby actuation of the nozzle is possible. The lock is held in the upper or unlocked position by friction.

In assembling the apparatus, the handle 18 is inserted into the sleeve 16 through the lower slot 48. The T-shape of that slot accommodates the projection 50 of the handle. With the projection 50 centered within the recess 49 of the sleeve 16, the sleeve is inserted onto the canister such that the lugs 36 snap into the canister groove 38, and the canister nozzle 22 enters the aperture 51 (see FIG. 17). The other sleeve 14 is inserted onto the opposite end of the canister and is depressed to enable the hubs 24 to be inserted into the recesses of a standard holder or fixture 26, with the handle 18 oriented vertically. Since this insertion is achieved without causing the handle 18 to be depressed, there is no risk of accidentally dispensing foam.

To actuate the apparatus, the tab 122 is placed in the unlock mode, and the user pushes against the lower end of the handle to produce rotation thereof in a direction B toward the nozzle (FIG. 4), whereupon the nozzle is radially depressed to emit foamable liquid. The user can perform this function with a thumb while holding tissue T beneath the handle (see FIG. 4). The liquid travels downwardly through the passage 52 and exits the discharge channels. The expansion of the liquid in the chamber 110 just prior to exiting the discharge channels results in a slowdown thereof and a gentle exiting of foam onto the tissue. Thus, the risk of the foam deflecting from the tissue is reduced.

It will be appreciated that the sleeve 16 could be permanently affixed to the canister, whereby the entire apparatus 10 would be replaced when the canister has been emptied. Alternatively, the sleeve 16 could be made readily removable (by prying out the flexible elements 34) to enable the user to replace only the canister.

Although the canister has been disclosed as having a nozzle which is actuable upon being radially depressed, the canister could, if desired, be provided with a nozzle which is actuated upon being axially depressed.

The present apparatus can also be used in connection with a canister which contains a non-pressurized flowable substance, e.g., a lotion, in which the handle is oscillated repeatedly in order to pump the lotion from the canister. In such a case, the presence of an expansion chamber immediately upstream of the discharge channels would probably be eliminated.

While the invention has been described in terms of various preferred embodiments, the skilled artisan will appreciate that various modifications, substitutions, omissions and changes may be made without departing from the spirit thereof. Accordingly, it is intended that the scope of the present invention be limited solely by the scope of the following claims.

What is claimed is:

1. Apparatus for rotatably mounting a roll of tissue in a holder and for dispensing a flowable substance, comprising:

a canister comprising a body containing a flowable substance, and a discharge nozzle at one end of said body, said canister adapted to be coaxially disposed within a core of a tissue roll, support means mounted on said canister body and including first and second support members disposed at opposite ends of said canister body, said first and second support members carrying first and second mounting means, respectively, which are coaxial and rotatably mountable in a holder, and a dispensing handle mounted on said second support member and extending laterally outwardly therefrom, said handle including:

an aperture receiving said canister nozzle, and a passage extending laterally of said aperture, one end of said passage communicating with said aperture and another end of said passage defining an outlet opening adjacent an outer end of said handle, said dispensing handle being movable relative to said second support member to cause said canister nozzle to be depressed and emit a flowable substance which travels through said passage and exits through said discharge outlet.

2. Apparatus according to claim 1, wherein said aperture comprises a hollow projection into which said nozzle extends.

3. Apparatus according to claim 1, wherein said canister contains a substance under pressure.

4. Apparatus according to claim 3, wherein said canister body contains a foamable liquid, said passage including an expansion chamber disposed immediately upstream of said discharge outlet to reduce the speed of said foamable liquid.

5. Apparatus according to claim 4, wherein said discharge outlet comprises a plurality of holes communicating with said expansion chamber.

6. Apparatus according to claim 1, wherein each of said first and second support members comprises a sleeve having a recess which receives a respective end of said canister body, said second sleeve including a slot through which said handle extends, said slot sized to permit said handle to move toward said canister body to cause said canister nozzle to be depressed.

7. Apparatus according to claim 6, wherein said second sleeve includes resilient latching elements for releasably securing said second sleeve to said canister body.

8. Apparatus according to claim 1, wherein said first and second mounting means comprise oppositely projecting cylindrical hubs.

9. Apparatus according to claim 1 including a roll of tissue mounted on said canister, said handle extending laterally beyond an outer cylindrical surface of said roll.

10. Apparatus according to claim 1 including yieldable biasing means permitting said first support member to move axially relative to said canister body.

11. Apparatus according to claim 1, including manually actuable locking means movable to a locking position to prevent movement of said handle for depressing said canister nozzle.

12. Apparatus according to claim 11, wherein said locking means is mounted in said handle.

13. Apparatus for rotatably mounting a roll of tissue in a holder and for dispensing a foam substance, comprising:

a canister comprising a body containing a foamable liquid under pressure, and a discharge nozzle at one end of said body, said canister adapted to be disposed coaxially in a core of a tissue roll, support means mounted on said canister body and including first and second support members disposed at opposite ends of said canister body, said first and second support members carrying first and second mounting means, respectively, which are coaxial and rotatably mountable in a holder, and a dispensing handle mounted to said second support member and extending laterally therefrom, said handle including a passage one end of which communicates with said canister nozzle and an opposite end of which defines a discharge outlet, said passage including an expansion chamber disposed immediately upstream of said discharge outlet to reduce the speed of the foamable liquid emitted from said canister nozzle and flowing through said passage, said handle being displaceable to depress said canister nozzle to cause the liquid to be emitted.

14. Apparatus according to claim 13, wherein said discharge outlet comprises a plurality of holes communicating with said expansion chamber.

15. Apparatus according to claim 13, wherein said first and second support members comprise first and second sleeves having coaxial recesses for receiving the ends of said canister body.

16. Apparatus according to claim 15, wherein said handle is movable relative to said second sleeve for depressing said canister nozzle.

17. Apparatus according to claim 16, wherein said handle extends through a slot in said second sleeve, a portion of said handle disposed in said second recess including an aperture opening toward said first sleeve for receiving said canister nozzle, said passage communicating with said aperture.

18. Apparatus according to claim 17, wherein said aperture is defined by a hollow projection extending toward said first support member.

19. Apparatus for rotatably mounting a roll of tissue in a holder and for dispensing a flowable substance, comprising:

a first sleeve having a first recess for receiving one end of a canister body, and first mounting means rotatably mountable in a holder, a second sleeve having a second recess arranged to be coaxial with said first recess for receiving an opposite end of a canister body, and second mounting means rotatably mountable in a holder and arranged to be coaxial with said first mounting means, and a dispensing handle mounted in said second recess and extending laterally outwardly therefrom through a slot in said second sleeve, said handle including:

an aperture disposed within said second recess and opening toward said first sleeve to receive a canister nozzle, and a passage extending laterally of said aperture, one end of said passage communicating with said aperture and another end of said passage defining an outlet opening adjacent an outer end of said handle, said dispensing handle being movable relative to said second sleeve to cause a canister nozzle in said aperture to be depressed and emit a flowable substance which travels through said passage and exits through said discharge outlet.

20. Apparatus for rotatably mounting a roll of tissue in a holder and for dispensing a foam substance, comprising:

a first support member for supporting one end of a canister body and including first mounting means rotatably mountable in a holder, a second support member for supporting an opposite end of a canister body and including second mounting means rotatably mountable in a holder and arranged to be coaxial with said first mounting means, and a dispensing handle mounted to said second support member and extending laterally therefrom, said handle including a passage one end of which communicates with a canister nozzle and an opposite end of which defines a discharge outlet, said passage including an expansion chamber disposed immediately upstream of said discharge outlet to promote foaming of a pressurized foamable liquid emitted from a canister nozzle and flowing through said passage, said handle being displaceable to depress a canister nozzle to cause the liquid to be emitted.

* * * * *